US012281367B2

(12) United States Patent
Ren et al.

(10) Patent No.: US 12,281,367 B2
(45) Date of Patent: Apr. 22, 2025

(54) DEVICE AND METHOD FOR CONTINUOUSLY APPLYING TRANSVERSE TENSION IN ANNEALING PROCESS OF ULTRA-THIN STRIP

(71) Applicant: Taiyuan University of Technology, Taiyuan (CN)

(72) Inventors: Zhongkai Ren, Taiyuan (CN); Jingbi Yang, Taiyuan (CN); Xiao Liu, Taiyuan (CN); Tao Wang, Taiyuan (CN); Peng Chen, Taiyuan (CN); Xiaobao Ma, Taiyuan (CN); Liping Bian, Taiyuan (CN)

(73) Assignee: Taiyuan University of Technology, Taiyuan (CN)

( * ) Notice: Subject to any disclaimer, the term of this patent is extended or adjusted under 35 U.S.C. 154(b) by 146 days.

(21) Appl. No.: 17/901,045

(22) Filed: Sep. 1, 2022

(65) Prior Publication Data

US 2024/0052446 A1 Feb. 15, 2024

(30) Foreign Application Priority Data

Aug. 9, 2022 (CN) ..... 202210948797.2

(51) Int. Cl.
*C21D 8/02* (2006.01)
*B21B 1/00* (2006.01)
(Continued)

(52) U.S. Cl.
CPC ..... *C21D 8/0252* (2013.01); *B21B 1/26* (2013.01); *B21B 1/40* (2013.01); *B21B 15/00* (2013.01); *C21D 1/26* (2013.01); *C21D 7/13* (2013.01)

(58) Field of Classification Search
CPC ..... C21D 8/0252; C21D 1/26; C21D 7/13; C21D 9/56; C21D 9/564; C21D 1/30;
(Continued)

(56) References Cited

U.S. PATENT DOCUMENTS 2,181,738 A * 11/1939 Otis ..... C21D 9/56 432/83
3,501,135 A * 3/1970 Forslund ..... F27B 9/28 432/59
(Continued)

FOREIGN PATENT DOCUMENTS

CN 111004910 * 4/2020 ..... C21D 11/00
CN 111004910 A * 4/2020 ..... C21D 11/00

*Primary Examiner* — Jessee R Roe
*Assistant Examiner* — Michael Aboagye

(57) ABSTRACT

A device for continuously applying a transverse tension in an annealing process of an ultra-thin strip, including an unfolding and receiving mechanism for unwinding and winding the strip and an orthopedic mechanism for correcting the strip including an annealing furnace, and two orthopedic assemblies fixedly arranged inside the annealing furnace; the two orthopedic assemblies are symmetrically arranged on both sides of the strip, are parallel to an advancing direction of the strip and correspond to side edges of the strip, and include annular guide rails; each annular guide rail is fixedly connected with the annealing furnace and is slidably connected with an orthopedic part; the orthopedic part corresponds to each side edge of the strip, and each annular guide rail is internally provided with a driving part; the driving part is in transmission connection with the orthopedic part, and the orthopedic part is communicated with an air source part.

8 Claims, 8 Drawing Sheets

(51) Int. Cl.

| | |
|---|---|
| ***B21B 1/26*** | (2006.01) |
| ***B21B 1/40*** | (2006.01) |
| ***B21B 15/00*** | (2006.01) |
| ***C21D 1/26*** | (2006.01) |
| ***C21D 7/13*** | (2006.01) |

(58) Field of Classification Search
CPC .. C21D 11/00; B21B 1/26; B21B 1/40; B21B 15/00
USPC ..... 266/89, 102, 103
See application file for complete search history.

(56) References Cited

U.S. PATENT DOCUMENTS 4,012,028 A * 3/1977 Dunaevsky ..... C21D 9/56
242/532.5
4,363,471 A * 12/1982 Yanagishima ..... C21D 9/56
266/259
7,137,437 B2 * 11/2006 Zajber ..... B21B 1/463
164/452

* cited by examiner

DEVICE AND METHOD FOR CONTINUOUSLY APPLYING TRANSVERSE TENSION IN ANNEALING PROCESS OF ULTRA-THIN STRIP

CROSS-REFERENCE TO RELATED APPLICATIONS

This application claims priority to Chinese Patent Application No. 202210948797.2, filed on Aug. 9, 2022, the contents of which are hereby incorporated by reference.

TECHNICAL FIELD

The application belongs to the technical field of rolling equipment, and in particular relates to a device and a method for continuously applying a transverse tension in an annealing process of an ultra-thin strip.

BACKGROUND

In a process of cold-rolled ultra-thin strip production, an annealing treatment is needed to eliminate cold-rolled hardening and restore a plasticity, so as to obtain expected physical and physical-chemical properties. However, after the annealing treatment, on the one hand, a strip buckling is caused, on the other hand, buckling and other instability phenomena in a secondary forming process of the strip are caused, thus eventually leading to a low forming quality and a low yield of the strip. Therefore, it is necessary to design a a device and a method for continuously applying a transverse tension in an annealing process of an ultra-thin strip to solve the above problems.

SUMMARY

An objective of the application is to provide a device and a method for continuously applying a transverse tension in an annealing process of an ultra-thin strip, so as to solve the above problems and achieve the objective of improving a forming quality and a forming rate of the strip.

In order to achieve the above objective, the application provides following schemes: a device for continuously applying a transverse tension in an annealing process of an ultra-thin strip, which includes an unfolding and receiving mechanism for unwinding and winding a strip and an orthopedic mechanism for correcting the strip;

the orthopedic mechanism includes an annealing furnace, and two orthopedic assemblies are fixedly arranged inside the annealing furnace; the two orthopedic assemblies are symmetrically arranged on both sides of the strip, are parallel to an advancing direction of the strip and correspond to side edges of the strip, and the two orthopedic assemblies include annular guide rails; each annular guide rail is fixedly connected with the annealing furnace and is slidably connected with an orthopedic part; the orthopedic part corresponds to each side edge of the strip, and each annular guide rail is internally provided with a driving part; the driving part is in transmission connection with the orthopedic part, and the orthopedic part is communicated with an air source part; and the unfolding and receiving mechanism includes an unfolding part and a receiving part, one end of the strip is wound on the unfolding part, and the other end of the strip passes through the annealing furnace and is wound on the receiving part.

Optionally, the orthopedic part includes a plurality of guide rail trolleys; the plurality of guide rail trolleys are slidably arranged at a top of each annular guide rail at equal intervals, and are all in transmission connection with the driving part; the top of each guide rail trolley is slidably connected with a pneumatic part, one end of the pneumatic part corresponds to the side edge of the strip, and the other end of the pneumatic part is communicated with the air source part.

Optionally, each pneumatic part includes a slide block, a bottom end of the slide block is slidably connected with a top end of each guide rail trolley, and the top end of the slide block is fixedly connected with a pneumatic finger; one end of the pneumatic finger is slidably connected with two plane jaws correspondingly arranged up and down, and the other end of the pneumatic finger is fixedly connected with a cylinder; a piston end of the cylinder is fixedly connected with a cam rod, the cam rod is slidably arranged in a cam groove of each annular guide rail, and the pneumatic finger and the cylinder are communicated with the air source part.

Optionally, the air source part includes an air source, and an outlet of the air source is connected with an f.r.l (filter regulator lubricator); the f.r.l unit is connected with a rotary joint, and the rotary joint is connected with the pneumatic finger and the cylinder.

Optionally, a pressure reducing valve and a sensor are arranged between the f.r.l unit and the rotary joint.

Optionally, the driving part includes a motor; the motor is arranged inside each annular guide rail, and output shaft of the motor is in transmission connection with the guide rail trolleys.

Optionally, the unfolding part includes an uncoiler, and the receiving part includes a coiler; the uncoiler is arranged at one end of the annealing furnace, the coiler is arranged at the other end of the annealing furnace, one end of the strip is wound on a rotating shaft of the uncoiler, and the other end of the strip passes through the annealing furnace and is wound on the rotating shaft of the coiler.

Optionally, both ends of the annealing furnace are provided with guide rollers, and the bottom end of strip is in rolling contact with the top ends of the guide rollers.

A use method of the device for continuously applying the transverse tension in the annealing process of the ultra-thin strip includes following steps:

obtaining a transverse tension value by a model algorithm after inputting production parameters into an L2 process system, sending the obtained transverse tension value to an L1 basic automation system, and controlling the air pressure of the air source part by a programmable logic controller (PLC) to drive the orthopedic part to apply the tension to the strip.

The application has following technical effects.

The device and the method according to the application realize an automatic application of the transverse tension to a certain extent, and have characteristics of safety and high efficiency; a control precision is increased through a closed-loop control of the transverse tension; and the device and the method have a wide application range, and are suitable for the ultra-thin strips of various sizes.

According to the application, the transverse tension is applied to the strip during a stress relief annealing process, so that on the one hand, a buckling of a strip steel caused by an unidirectional tension is weakened, and on the other hand, a residual stress along a transverse direction after the annealing of the strip steel is reduced, so that a transverse instability phenomenon in a secondary plastic forming process is avoided, and a secondary forming quality and a yield are better controlled.

BRIEF DESCRIPTION OF THE DRAWINGS

In order to more clearly explain embodiments of the application or technical solutions in the prior art, the following briefly introduces drawings that need to be used in the embodiments. Obviously, the drawings in the following description are only some embodiments of the application. For those of ordinary skill in the art, other drawings may be obtained according to these drawings without any creative effort.

DETAILED DESCRIPTION OF THE EMBODIMENTS

Technical solutions in embodiments of the application are clearly and completely described below with reference to drawings in the embodiments of the application. Obviously, the described embodiments are only part of the embodiments of the application, but not all of them. Based on the embodiments of the application, all other embodiments obtained by ordinary technicians in the field without creative labor are within a scope of the application.

In order to make the above objects, features and advantages of the application more obvious and understandable, the application is explained in further detail below with reference to the drawings and detailed description.

Figure 1:
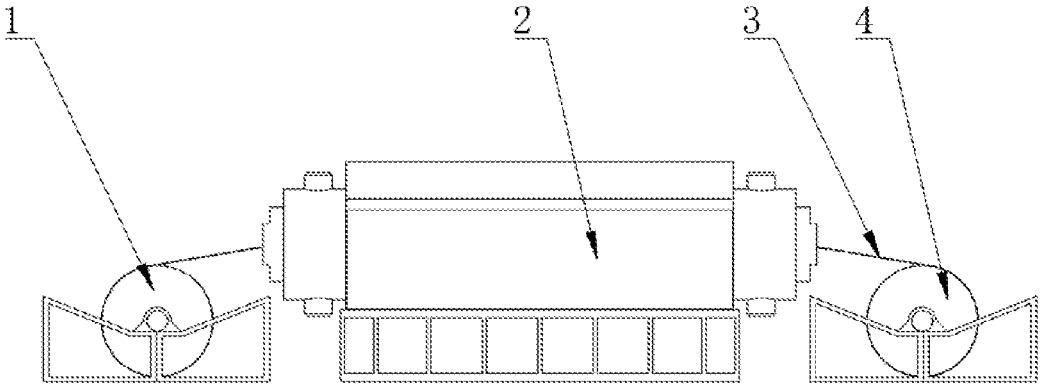
FIG. 1 is a schematic diagram of an overall structure of a device according to the application.
Figure 2:
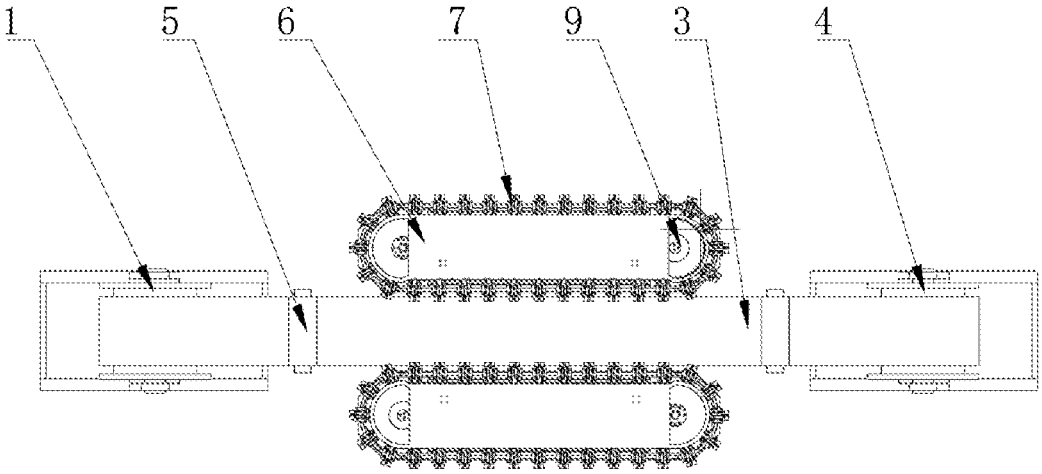
FIG. 2 is a plan view of a device according to the application.
Figure 3:
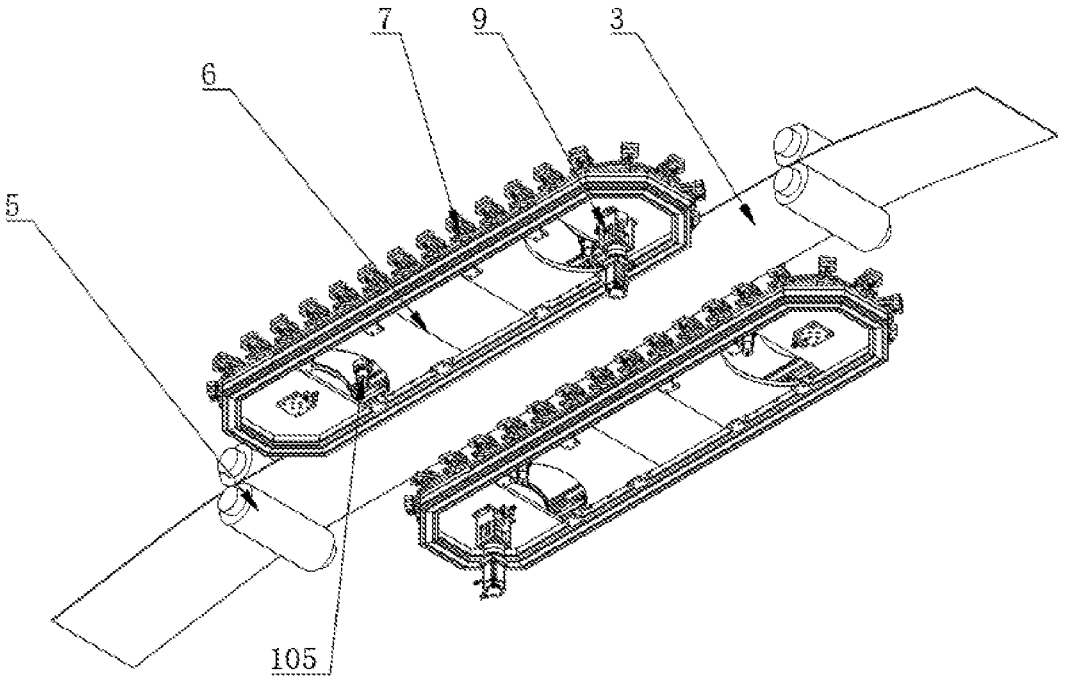
FIG. 3 is an isometric view of a device according to the application.
Figure 4:
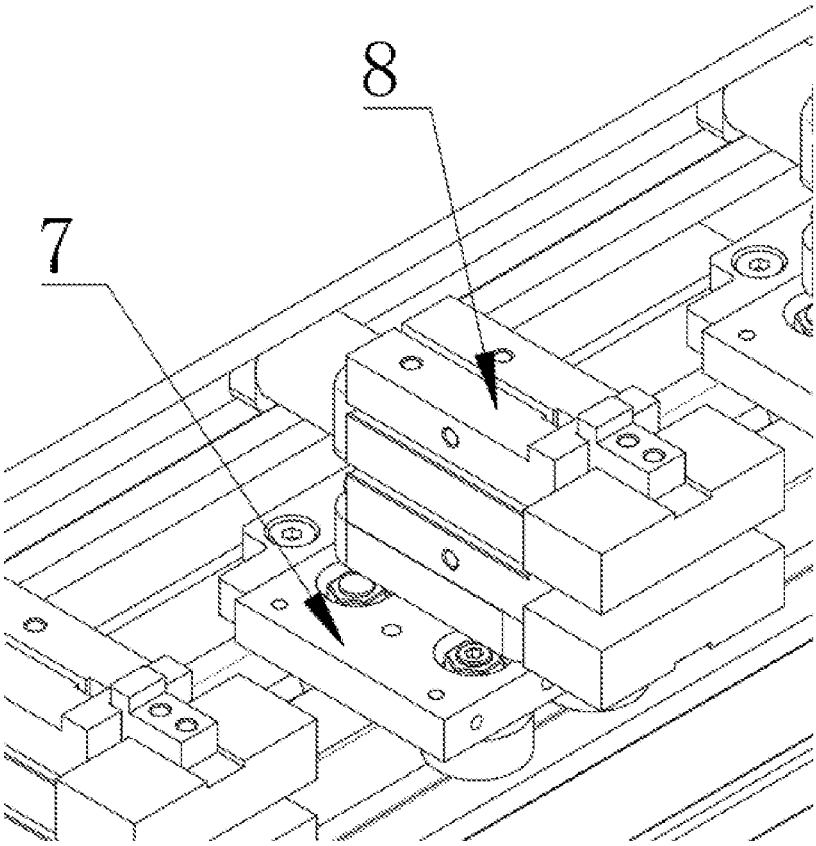
FIG. 4 is an isometric view of a guide rail trolley and a pneumatic part according to the application.
Figure 5:
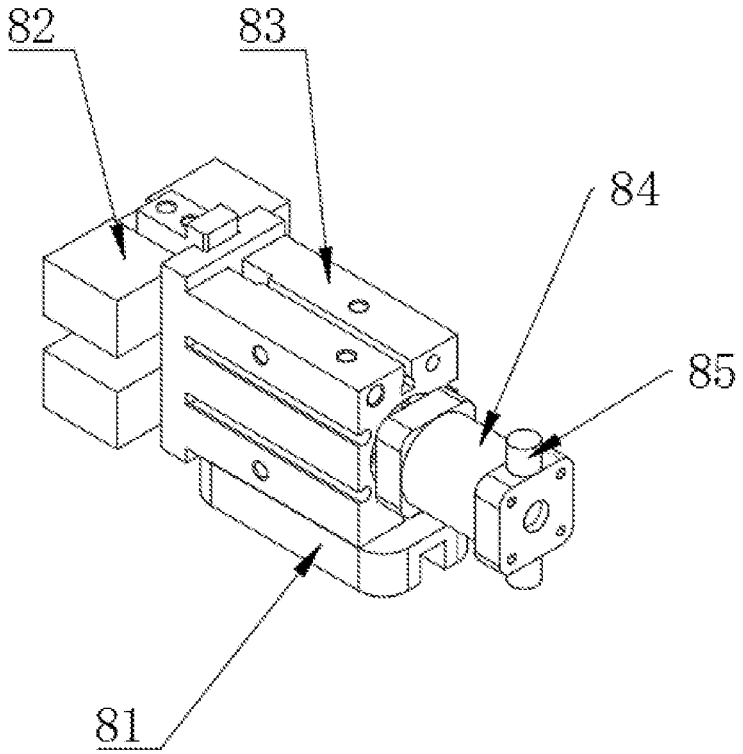
FIG. 5 is an isometric view of a pneumatic part according to the application.
Figure 6:
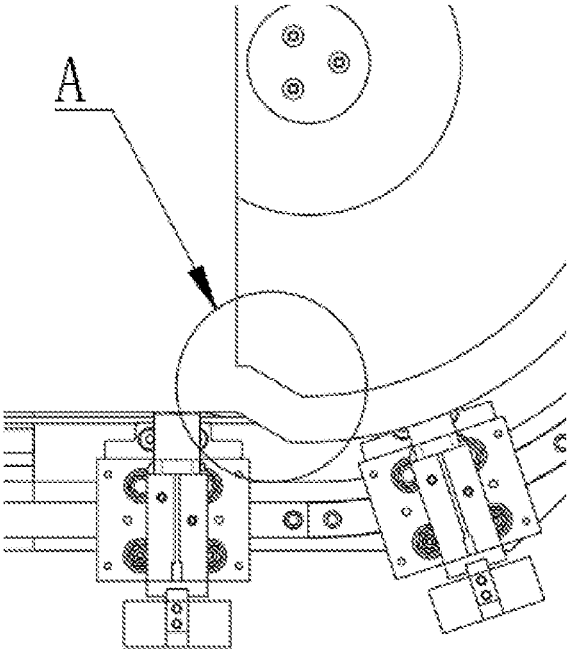
FIG. 6 is a partial schematic diagram of an annular guide rail according to the application.
Figure 7:
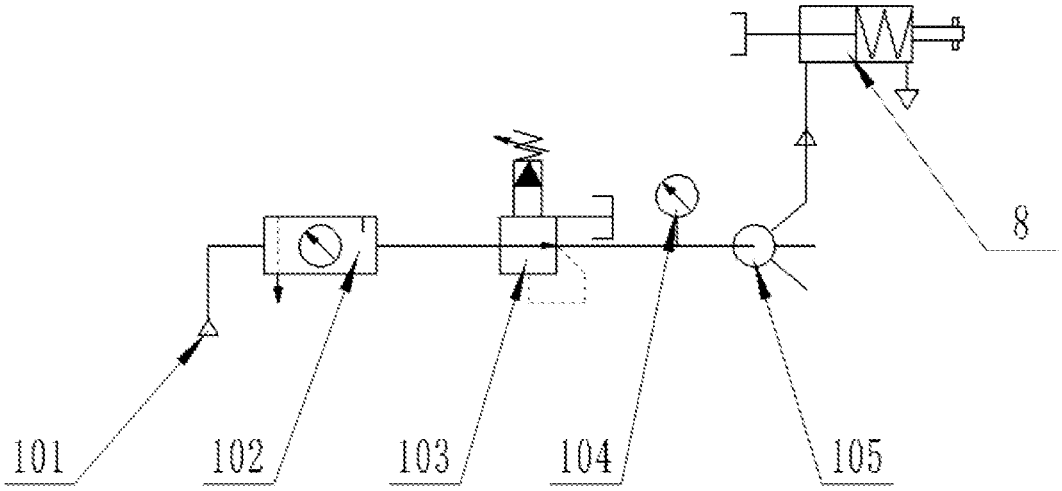
FIG. 7 is a control schematic diagram of an air source part according to the application.
Figure 8:
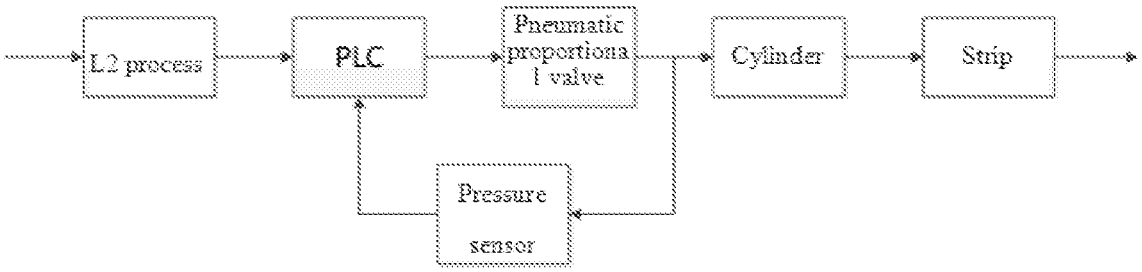
FIG. 8 is a flow chart of a use method according to the application.

With reference to FIGS. 1-8, the application discloses a device for continuously applying a transverse tension in an annealing process of an ultra-thin strip, which includes an unfolding and receiving mechanism for unwinding and winding a strip 3 and an orthopedic mechanism for correcting the strip 3;

the orthopedic mechanism includes an annealing furnace 2, and two orthopedic assemblies are fixedly arranged inside the annealing furnace 2; the two orthopedic assemblies are symmetrically arranged on both sides of the strip 3, are parallel to an advancing direction of the strip 3 and correspond to side edges of the strip 3, and the two orthopedic assemblies include annular guide rails 6; each annular guide rail 6 is fixedly connected with the annealing furnace 2 and is slidably connected with an orthopedic part; the orthopedic part corresponds to each side edge of the strip 3, and each annular guide rail 6 is internally provided with a driving part; the driving part is in transmission connection with the orthopedic part, and the orthopedic part is communicated with an air source part; and the unfolding and receiving mechanism includes an unfolding part and a receiving part, one end of the strip 3 is wound on the unfolding part, and the other end of the strip 3 passes through the annealing furnace 2 and is wound on the receiving part.

In an embodiment, the orthopedic part includes a plurality of guide rail trolleys 7; the plurality of guide rail trolleys 7 are slidably arranged at a top of each annular guide rail 6 at equal intervals, and are all in transmission connection with the driving part; the top of each guide rail trolley 7 is slidably connected with a pneumatic part 8, one end of the pneumatic part 8 corresponds to the side edge of the strip 3, and the other end of the pneumatic part 8 is communicated with the air source part.

In an embodiment, each pneumatic part 8 includes a slide block 81, a bottom end of the slide block 81 is slidably connected with a top end of each guide rail trolley 7, and the top end of the slide block 81 is fixedly connected with a pneumatic finger 83; one end of the pneumatic finger 83 is slidably connected with two plane jaws 82 which are correspondingly arranged up and down, and the other end of the pneumatic finger 83 is fixedly connected with a cylinder 84; a piston end of the cylinder 84 is fixedly connected with a cam rod 85, the cam rod 85 is slidably arranged in a cam groove of each annular guide rail 6, and the pneumatic finger 83 and the cylinder 84 are communicated with the air source part.

In an embodiment, the air source part includes an air source 101, and an outlet of the air source 101 is connected with an f.r.l (filter regulator lubricator) 102; the f.r.l unit 102 is connected with a rotary joint 105, and the rotary joint 105 is connected with the pneumatic finger 83 and the cylinder 84.

In an embodiment, a pressure reducing valve 103 and a sensor 104 are arranged between the f.r.l unit 102 and the rotary joint 105.

The f.r.l unit 102 is a pneumatic f.r.l unit, the pressure reducing valve 103 is a pneumatic proportional pressure reducing valve, the sensor 104 is an air pressure sensor, the rotary joint 105 is a pneumatic rotary joint, and the air source 101 may be an air compressor. After a pressure regulation and an oil-water separation by the f.r.l unit 102, compressed air enters the pressure reducing valve 103, and finally enters the cylinder 84 to push the piston, and the cylinder 84 outputs a tension. Since an output tension of the cylinder 84 is proportional to its internal pressure, the internal pressure of the cylinder 84 is controlled by the pressure reducing valve 103, so the output tension of the cylinder 84 may be controlled by changing a signal input to the pressure reducing valve 103.

In an embodiment, the driving part includes a motor 9; the motor 9 is arranged inside each annular guide rail 6, and output shaft of the motor 9 is in transmission connection with the guide rail trolleys 7.

The motor 9 is in transmission connection with the guide rail trolleys 7 through a timing belt, and the motor 9 drives the guide rail trolleys 7 to make a cyclic motion along each annular guide rail 6. After each pneumatic part 8 travels to a working section along with each guide rail trolley 7, the pneumatic part 8 works to make the flat clamping jaws 82 clamp the strip 3. Then, due to a change of a shape of the cam groove, the cam rod 85 moves laterally, pulling the cylinder 84, increasing a volume of gas in the cylinder 84, and generating a lateral pulling force on the pneumatic finger 83, thus exerting a transverse tension on the strip 3. An advancing speed and an advancing direction of the guide rail trolley 7 in the work section are consistent with a running speed and a running direction of the strip 3.

In an embodiment, the unfolding part includes an uncoiler 1, and the receiving part includes a coiler 4; the uncoiler 1 is arranged at one end of the annealing furnace 2, the coiler 4 is arranged at the other end of the annealing furnace 2, one end of the strip 3 is wound on a rotating shaft of the uncoiler 1, and the other end of the strip 3 passes through the annealing furnace 2 and is wound on the rotating shaft of the coiler 4.

In an embodiment, both ends of the annealing furnace 2 are provided with guide rollers 5, and the bottom end of strip 3 is in rolling contact with the top ends of the guide rollers 5.

The uncoiler 1 and the coiler 4 drive the strip 3 to move unidirectionally through the annealing furnace 2 and the guide rollers 5, and the two annular guide rails 6 are fixedly installed on both sides of the strip 3 in the annealing furnace 2. The motor 9 drives the guide rail trolleys 7 to make a cyclic motion along each annular guide rail 6. Each pneumatic part 8 is slidably mounted on the top of each guide rail trolley 7, and moves transversely relative to each guide rail trolley 7. The cam rod 85 on each pneumatic part 8 is connected with the pneumatic finger 83 through the cylinder 84, and the plane jaws 82 are slidably mounted on the pneumatic finger 83, so as to clamp or loosen the strip 3 with an operation of the pneumatic finger 83.

A use method of the device for continuously applying the transverse tension in the annealing process of the ultra-thin strip includes following steps:

obtaining a transverse tension value by a model algorithm after inputting production parameters into an L2 process system, sending the obtained transverse tension value to an L1 basic automation system, and controlling the air pressure of the air source part by a programmable logic controller (PLC) to drive the orthopedic part to apply the tension to the strip 3.

The L2 process system includes a rolling model calculation, a data acquisition and processing, and a process parameter optimization. After the production parameters are input, the L2 process system obtains the required transverse tension value through the model algorithm. After the L1 basic automation system receives the tension value, the PLC adjusts the air pressure of the air source part. The PLC monitors the pressure of the cylinder 84 in real time through the sensor 104 for a closed-loop control, thus ensuring that the output tension of the cylinder 84 is consistent with the tension given by the process system.

In the description of the application, it should be understood that an orientation or positional relationship indicated by terms "longitudinal", "lateral", "up", "down", "front", "back", "left", "right", "vertical", "horizontal", "top", "bottom", "inner", "outer" and so on are based on the orientation or positional relationship shown in the drawings, only for a convenience of describing the application, rather than indicating or implying that the device or an element referred to must have a specific orientation, be configured and operate in a specific orientation, and therefore may not be understood as limiting the application.

The above-mentioned embodiments only describe a preferred mode of the application, but do not limit the scope of the application. On a premise of not departing from the design spirit of the application, all kinds of modifications and improvements made by ordinary technicians in the field to the technical scheme of the application shall fall within the scope of protection determined by the claims of the application.

What is claimed is:

1. A device for continuously applying a transverse tension in an annealing process of an ultra-thin strip, comprising an unfolding and receiving mechanism for unwinding and winding a strip and an orthopedic mechanism; wherein the orthopedic mechanism comprises an annealing furnace, and two orthopedic assemblies fixedly arranged inside the annealing furnace; the two orthopedic assemblies are symmetrically arranged on both sides of the strip, and are parallel to an advancing direction of the strip and correspond to side edges of the strip, and the two orthopedic assemblies comprise annular guide rails; each annular guide rail is fixedly connected with the annealing furnace and is slidably connected with an orthopedic part; wherein the orthopedic part comprises a plurality of guide rail trolleys; the orthopedic part corresponds to each side edge of the strip, and each annular guide rail is internally provided with a driving part; the driving part is in transmission connection with the orthopedic part, and the orthopedic part is communicated with an air source part;

an air pressure of the air source part is controlled by a programmable logic controller to drive the orthopedic part to apply the tension to the strip; and the unfolding and receiving mechanism comprises an unfolding part and a receiving part, one end of the strip is wound on the unfolding part, and the other end of the strip passes through the annealing furnace and is wound on the receiving part.

2. The device for continuously applying the transverse tension in the annealing process of the ultra-thin strip according to claim 1, wherein the orthopedic part comprises a plurality of guide rail trolleys; the plurality of guide rail trolleys are slidably arranged at a top of each annular guide rail at equal intervals, and are all in transmission connection with the driving part; the top of each guide rail trolley is slidably connected with a pneumatic part, one end of the pneumatic part corresponds to the side edge of the strip, and the other end of the pneumatic part is communicated with the air source part.

3. The device for continuously applying the transverse tension in the annealing process of the ultra-thin strip according to claim 2, wherein each pneumatic part comprises a slide block, a bottom end of the slide block is slidably connected with a top end of each guide rail trolley, and the top end of the slide block is fixedly connected with a pneumatic finger; one end of the pneumatic finger is slidably connected with two plane jaws correspondingly arranged up and down, and the other end of the pneumatic finger is fixedly connected with a cylinder; a piston end of the cylinder is fixedly connected with a cam rod, the cam rod is slidably arranged in a cam groove of each annular guide rail, and the pneumatic finger and the cylinder are communicated with the air source part.

4. The device for continuously applying the transverse tension in the annealing process of the ultra-thin strip according to claim 3, wherein the air source part comprises an air source, and an outlet of the air source is connected with an f.r.l (filter regulator lubricator) unit; the f.r.l unit is connected with a rotary joint, and the rotary joint is connected with the pneumatic finger and the cylinder.

5. The device for continuously applying the transverse tension in the annealing process of the ultra-thin strip according to claim 4, wherein a pressure reducing valve and a sensor are arranged between the f.r.l unit and the rotary joint.

6. The device for continuously applying the transverse tension in the annealing process of the ultra-thin strip according to claim 2, wherein the driving part comprises a motor; the motor is arranged inside each annular guide rail, and output shaft of the motor is in transmission connection with the guide rail trolleys.

7. The device for continuously applying the transverse tension in the annealing process of the ultra-thin strip according to claim 1, wherein the unfolding part comprises an uncoiler, and the receiving part comprises a coiler; the uncoiler is arranged at one end of the annealing furnace, the coiler is arranged at the other end of the annealing furnace, one end of the strip is wound on a rotating shaft of the uncoiler, and the other end of the strip passes through the annealing furnace and is wound on the rotating shaft of the coiler.

8. The device for continuously applying the transverse tension in the annealing process of the ultra-thin strip according to claim 1, wherein both ends of the annealing furnace are provided with guide rollers, and the bottom end of strip is in rolling contact with the top ends of the guide rollers.

* * * * *